US005111783A

United States Patent [19]

Moore

[11] Patent Number: 5,111,783

[45] Date of Patent: May 12, 1992

[54] ROTARY VALVE SYSTEM FOR INTERNAL COMBUSTION ENGINES

[75] Inventor: Richard G. Moore, Decatur, Ga.

[73] Assignee: Jack P. Janetatos, a part interest

[21] Appl. No.: 633,765

[22] Filed: Dec. 26, 1990

[51] Int. Cl.[5] ..... F01L 7/10

[52] U.S. Cl. ..... 123/190.4; 123/190.6; 123/190.1

[58] Field of Search ..... 123/190 B, 190 BB, 190 R

[56] References Cited

U.S. PATENT DOCUMENTS 3,989,025 11/1976 Franco ..... 123/190 B
4,041,837 8/1977 Weidlich ..... 123/190 A
4,201,174 5/1980 Vallejos ..... 123/190 B
4,481,917 11/1984 Rus ..... 123/190 B
4,843,821 7/1989 Paul ..... 123/51 BA
4,936,262 6/1990 Paul ..... 123/25 C

*Primary Examiner*—E. Rollins Cross
*Assistant Examiner*—Erick Solis

[57] ABSTRACT

A fuel-air compression and timing device for an internal combustion engine of the Ottoman, four-stroke type wherein triangular rotors are in phased relationship with the pistons of the engine to sequence the intake and exhaust strokes and to provide a double compression of the fuel-air mixture by the rotors and the pistons.

13 Claims, 3 Drawing Sheets

ROTARY VALVE SYSTEM FOR INTERNAL COMBUSTION ENGINES

FIELD OF INVENTION

This invention relates to a mechanism for timing and controlling the strokes of a four stroke internal combustion engine by directly coupling a triangular rotor system to the upper ends of the combustion chambers so as to increase the volumetric efficiency with which the fuel-air mixture enters the combustion chamber and at the same time provide an accurate timing mechanism.

BACKGROUND OF THE INVENTION

In the conventional internal combustion engine, the timing of the intake, compression, combustion and exhaust strokes is accomplished with poppet valves activated by cams and springs. Many workers in the prior art have also attempted to perform timing with rotary devices. Drawbacks to the device of the prior art are that adequate timing and durability cannot be obtained while gaining the desired volumetric efficiency. The instant invention substantially increases volumetric efficiency by utilizing a triangular rotor executing an epitrochoidal path and having the surface of said rotor form the top of the combustion chamber.

The Weidlick U.S. Pat. No. 4,041,837 discloses triangular vanes for sequencing the four strokes of an engine but did not conceive, teach or arrange the parts to gain the opportunity to utilize the unique qualities of a triangular vane system to obtain volumetric efficiency.

Many efforts have been made to increase the flow of the fuel-air mixture into the combustion chamber with varying degrees of success. Many of these efforts have taken the form of multiple valve arrangements, supercharging, turbo-charging and tuned intake and exhaust manifold systems. The advantages of these prior art efforts are offset by increased complexity and costs.

SUMMARY OF THE INVENTION

A principle objective of this invention is to provide a rotary timing mechanism for intake and exhaust purposes that increases engine efficiency and performance by conserving the power necessary to operate conventional engines by increasing volumetric efficiency.

A further objective of the invention is to utilize the ruggedness of triangular rotors that follow an epitrochoidal path within epitrochoidal chambers and directly and sequentially communicating the intake and exhaust ports to the interiors of the combustion chambers of internal combustion engines.

A still further objective of this invention is to provide a rugged triangular rotor valve arrangement for an internal combustion engine that will take little power from the combustion stroke and at the same time provide a system requiring reduced servicing.

Another objective of this invention is to provide a valving-timing mechanism that can readily serve as a replacement on internal combustion engines with conventional valving mechanisms.

A still further objective of this invention is to provide triangular rotors within a two-lobed epitrochoidal chambers to provide the intake and exhaust systems of an engine and the cylinder combustion area with timing by coordinating the movements of triangular rotors with the piston strokes so that proper sequencing of the engine is achieved.

Another very important objective of the invention is to utilize one of the planar surface of the rotor to form the upper surface of a combustion chamber as said planar surface spans the combustion chamber.

These and other objectives of the invention will become more apparent when the following description is read in conjunction with the accompanying drawings.

DESCRIPTION OF PREFERRED EMBODIMENT

Figure 1:
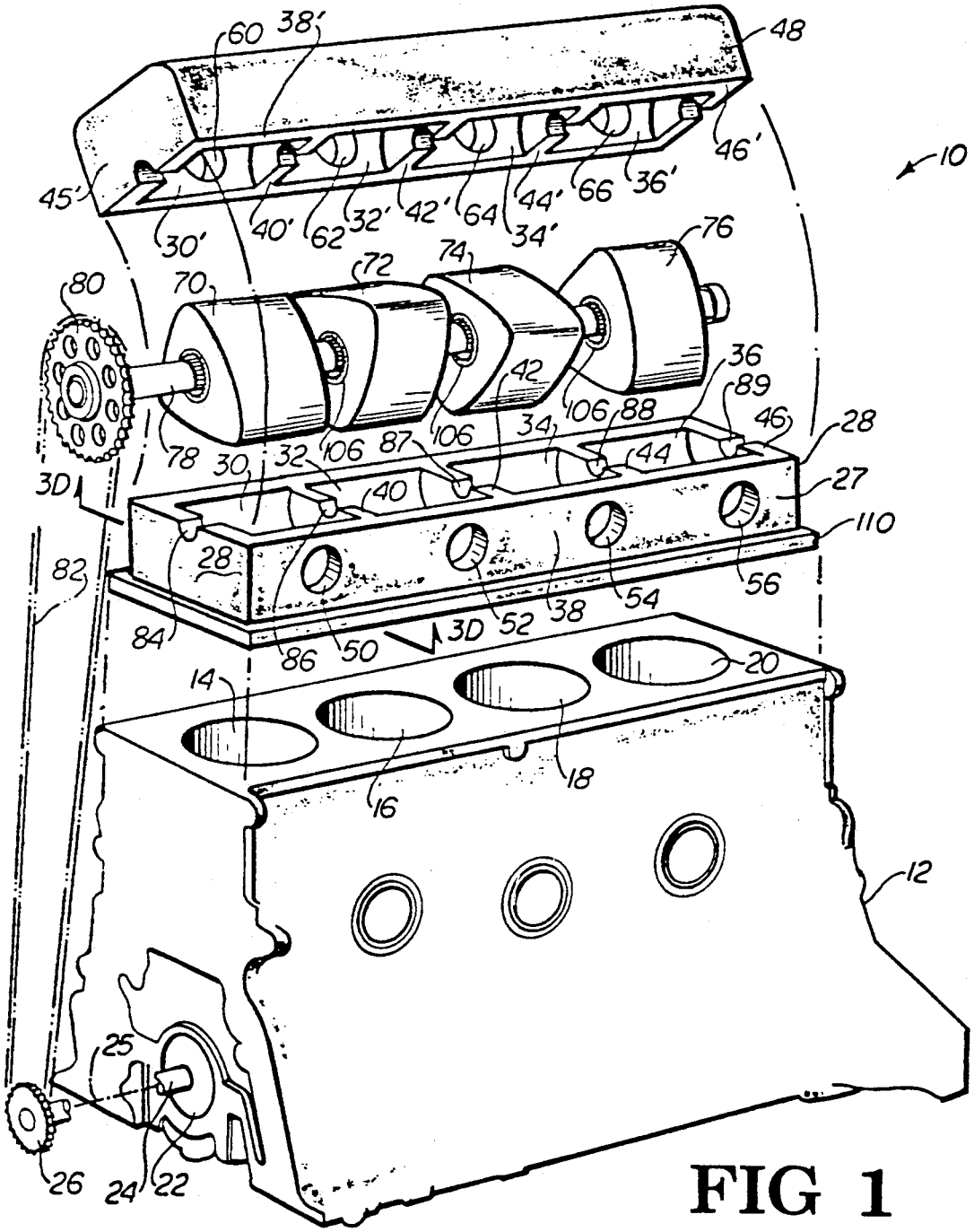
FIG. 1 is a diagrammatic, exploded, perspective of an internal combustion engine showing those components of the engine necessary to understand the invention.

Referring now to the drawings wherein like numerals indicate like parts, the internal combustion engine of this invention is generally indicated by the numeral 10. The gist of this invention is to improve the volumetric efficiency of the engine by utilizing rotary valves of the Wankel type to replace the cam shaft, valves and valve springs of more conventional designs. This description discloses the invention in diagrammatic-schematic fashion for ease of understanding the invention and explaining the operation thereof.

An engine block 12 having four cylinders 14, 16, 18 and 20 is shown in FIG. 1. In conventional fashion, the block is formed with a crankshaft bushing 22 in which a crank shaft 24 is received. A crankshaft extension 25 protrudes to a point beyond the block 12. A sprocket 26 is mounted at the outer end of shaft extension 25. The extension 25 is shown schematically as a line.

Disposed over the engine block 12 is a chamber housing 28 having a plurality of chambers 30, 32, 34 and 36 formed therein. The housing is comprised of a rectangular sidewall 38 having a plurality of transverse dividing walls 40, 42, 44, and end walls 45 and 46. The dividing walls, together with the housing end walls and a bottom, form the aforementioned chambers.

A header 48 is disposed over housing 28. It is formed with chambers 30', 32', 34' and 36' which match corresponding chambers of housing 28. The header is formed of a rectangular side wall 38' having the same dimension as side wall 38 and has a plurality of transverse dividing walls 40', 42', 44', and end walls 45' and 46', which together with the header's top wall 49, form these upper chambers.

The block 12, housing 28 and header 48 are connected by conventional means and will have appropriate gaskets between their matching surfaces. Since the header and housing when joined have common dividing walls, end walls and chambers, the elements of "joined" units are hereinafter referred to solely by numerals without their prime marks.

Side wall 27 of housing 28 is formed with a plurality of intake ports 50, 52, 54 and 56 which communicate respectively with chambers 30, 32, 34 and 36. Each of these ports is connected to the fuel-air mixture from the engine's fuel supply.

The opposing side wall 47 of header 48 is formed with a plurality of exhaust ports 60, 62, 64 and 66 which communicate respectively with the chambers 30, 32, 34 and 36. The respective positions of the ports with respect to one another can be understood by reference to FIGS. 2A-2D inclusive. The header 48 is enclosed by top 68. Exhaust openings or ports 60, 62, 64 and 66 are connected to the vehicle's exhaust system.

The epitrochoidal chambers 30, 32, 34 and 36 respectively receive triangular rotors 70, 72, 74 and 76. The rotors are carried by a Wankel-like shaft 78. One end of the shaft 78 carries a sprocket 80. The sprocket 80 and sprocket 26 are connected via a chain or belt 82. The dividing walls 40 and 42, 44 and 46 and the end walls are formed with bushings 84, 86, 87, 88 and 89 to receive the Wankel-type shaft 78.

The cylinders 14, 16, 18 and 20 respectively receive reciprocating pistons 90, 92, 94 and 96. Only piston 90 is shown. Connecting rods 98, 100, 102 and 104 connect the pistons to the crankshaft 24 in a conventional manner. Only the connecting rod 98 is shown.

The various sealing means for the pistons and the Wankel-type triangular rotors are not shown. The sealing means for these reciprocating pistons and triangular rotors are known to the art and conventional sealing means are utilized.

The rotors are driven in an epitrochoidal path by eccentric assemblies indicated by the numeral 106. Reference to U.S. Pat. No. 4,041,837 discloses one suitable assembly for producing this motion. Wankel-like rotors and their sealing means are well known to the engine arts.

Figure 3D:
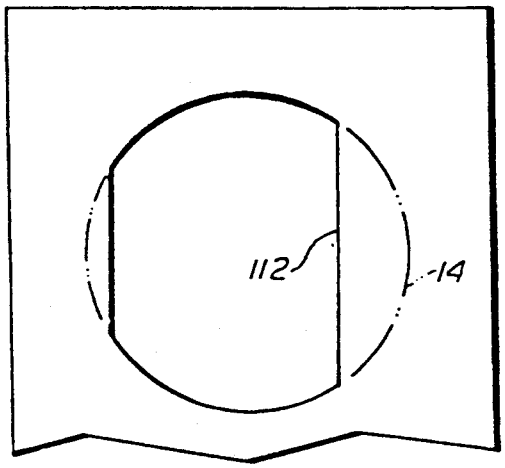
FIG. 3D is a bottom view of the housing as viewed from the cylinder of an engine block disclosing the increased porting.
Figure 4:
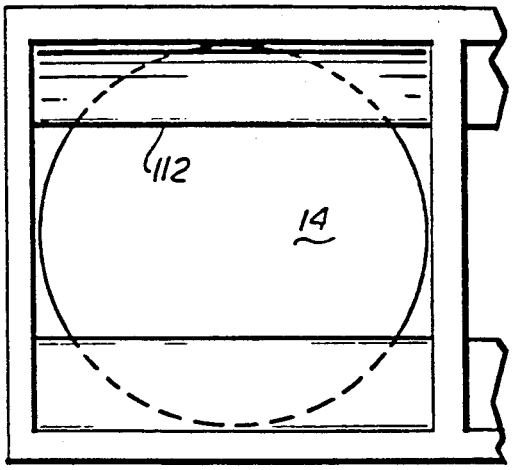
FIG. 4 is a top plan of the lower half of a rotor chamber disclosing its relationship to the combustion chamber therebelow.

The bottom 110 of the housing is formed with four openings 112 which have dimensions approaching that of their respective cylinders 14, 16, 18, and 20. One of the openings 112 can be seen in FIG. 3D and FIG. 4 and a cross-section thereof is seen in FIGS. 2A-2D. A plan view of the opening 112 is seen in FIG. 4.

The four principle phases or strokes of the engine are represented in FIGS. 2A, 2B, 2C and 2D. The movement of triangular rotor 40, piston 90 and their associated elements are used for this purpose. The rotor tips are indicated by the letters A, B and C for descriptive purposes.

Figures 2A, 2B, 2C, 2D:
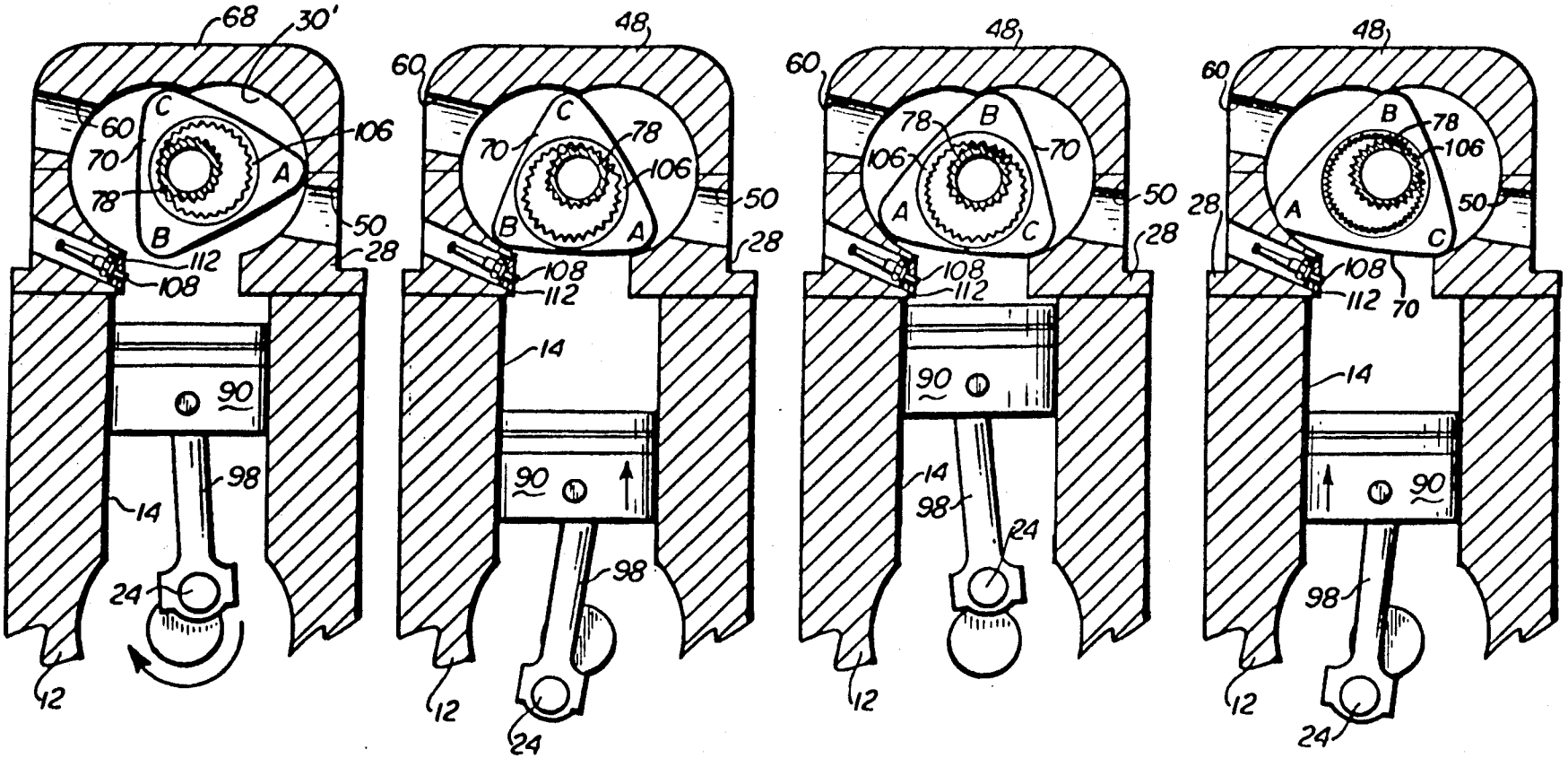
FIGS. 2A through 2D disclose the positions of the engine components during different phases of the working cycle.

In FIG. 2A, the components are located so that a fuel-air mixture will enter a chamber generally defined by the opening 112, the cylinder above the top surface of piston 90 and the rotor's exterior planar surface between A and B. As viewed, rotor movement is clockwise. Thus, the opening 112 is clockwise of intake port 50 and exhaust port 60 is clockwise of opening 112. FIG. 2A discloses the beginning of the intake stroke. Here, piston 90 is about to move downwardly. The vacuum created will draw an air-fuel mixture into the system. It should be noted that the tips A, B and C that follow the contours of chamber 30 are rounded to that extent necessary to accommodate the use for which the engine is designed.

As piston 90 moves downwardly, tips A and B will move away from port 50 until the position shown in FIG. 2B is reached. At this point the air-fuel-mixture is trapped between surface A-B and the piston 90. In this disposition, ports 50 and 60 are not in communication with cylinder 14. As piston 90 moves upwardly, compression begins. Additional compression is gained during this stroke because the surface A-B of rotor 40 is downward because of the epitrochoidal effect. Thus, while increasing volumetric efficiency, further advantages are obtained by this double compression from the sequencing mechanism.

When piston 90 reaches a position just before top dead center (See FIG. 26), a combustion spark is caused by spark plug 108. The piston is driven downwardly from its FIG. 2C position by the forces of combustion and will rotate the crankshaft. Concurrently, rotor 40 is driven clockwise by the combustion which will simultaneously rotate shaft 78.

As the rotor 40 continues to rotate, the exhaust port 60 is communicated to the combustion chamber. The spent gases are caused to be exhausted through exhaust port 60 as the piston moves upwardly from its position near the bottom position shown in FIG. 2D. FIG. 2D shows the piston as it starts its stroke to exhaust the spent gases.

The combustion chamber is at its most reduced volume when formed by the surface A-B, the top of piston 90 and the inner surface of opening 112 when the piston is at the top of its stroke. The rounded tips provide a valve overlap effect. The inertia of the moving exhaust gases will produce a scavaging effect that will draw the air-fuel mixture into the system for the intake stroke of the following cycle. The tip A will isolate exhaust port 60 and piston 90 and rotor 40 will draw the next charge of the fuel-air mixture into the system.

It should be noted that during operation, crankshaft 24 and shaft 78 transmit torque simultaneously thereby increasing total power output.

Figure 3A:
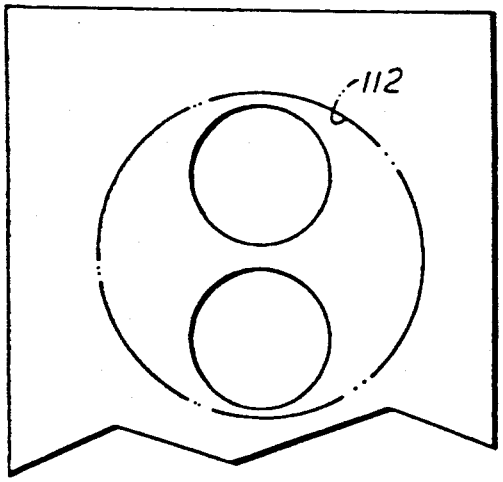
FIG. 3A is a schematic representation of the areas available for fuel transfer in a prior art two valve system.
Figure 3B:
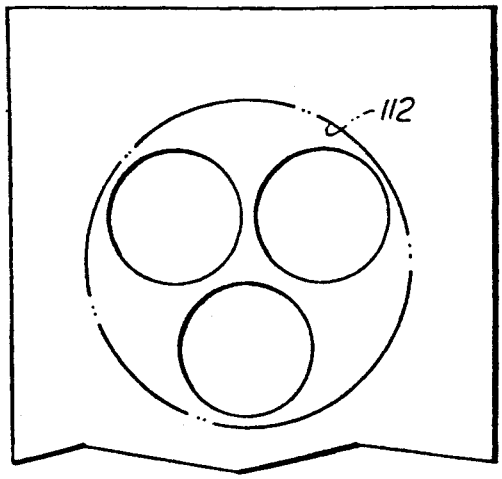
FIG. 3B is a schematic representation similar to FIG. 3A showing a three valve unit.
Figure 3C:
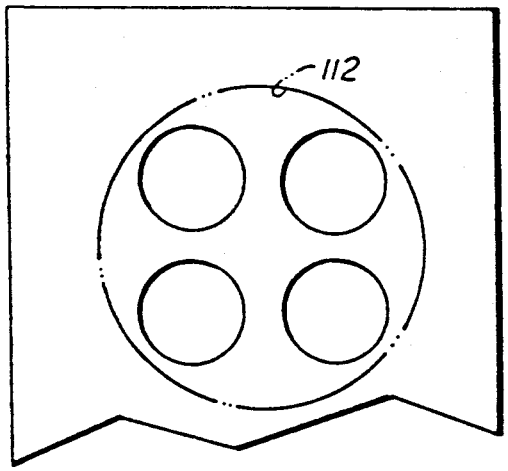
FIG. 3C is a schematic representation similar to FIG. 3A showing a four valve unit.

As stated above, one of the principle reasons engine efficiency is increased is because the system of this invention increases the size of transfer opening between the fuel intake and the combustion chamber. It improves the engine's ability to "breathe". This can best be understood by reference to FIGS. 3A, 3B, 3C and 3D. In FIG. 3A, the large circle represents the piston cylinder opening and the smaller circles the degree of communication provided to the cylinder by intake and exhaust poppet seats. FIG. 3B shows an arrangement with two intakes and one exhaust and FIG. 3C shows an arrangement with a double intake and a double exhaust. Compare any of these with the substantially larger area for intake and exhaust provided by opening 112. It is readily seen that volumetric efficiency is maximized.

The gearing arrangement between the crankshaft 24 and the rotor shaft 78 will remain the same as in conventional designs; that is, a 2:1 ratio. This is true because the ratio between the rotor to shaft is 3:1. Using the side between two tips tip of the rotor for the complete 4 cycles of the piston engine gives an overall ratio of rotor to crankshaft of 6:1.

While there has been disclosed an effective and efficient embodiment of the invention, it should be well understood that the invention is not limited to such an embodiment as there might be changes made in the arrangement, disposition and form of the parts without departing from the principle of the present invention as comprehended within the scope of the accompanying claims.

I claim:

1. A fuel intake and exhaust system for use with a four stroke engine of a type having an engine block formed with at least one piston cavity having an upper opening in the top surface of said block a piston having an upper surface reciprocating in said cavity toward and away from said upper opening, a crankshaft and a connecting rod secured to said piston and crankshaft, the improvement comprising:

a housing disposed over said block and having an interior chamber formed with a lower opening located directly over said upper opening and said lower opening having approximately the same dimension as said upper opening; said housing formed with fuel intake and exhaust ports; a rotor shaft rotatably received in said chamber; a triangular rotor having first second and third surfaces carried by said shaft and movable therewith; means connecting said crankshaft to said rotor shaft for relative rotative movement therebetween;

said first surface of said rotor spanning said upper opening at a particular rotative disposition of said rotor while isolating said intake and exhaust ports from said piston cavity.

2. The invention of claim 1 wherein a peripheral sidewall of said upper opening, said first rotor surface, and the upper surface of said piston form a combustion chamber; and spark inducing means located in said combustion chamber.

3. The invention of claim 2 wherein said interior chamber is epitrochoidal and said triangular rotor is formed with three rounded tips.

4. The invention of claim 3 wherein drive means moves said rotor in an epitrochoidal path.

5. The invention of claim 4 wherein said means connecting said crankshaft with said drive shaft are dimensioned to cause said first rotor surface and said upper surface of said piston to be near their minimum distance from one another when spark activation occurs.

6. A fuel intake and exhaust system for use with a four stroke engine of a type having an engine block formed with at least one cylindrical piston cavity having a circular upper opening in the top surface of said block and the diameter of said opening being the same as the diameter of said cavity, a piston having an upper surface reciprocating in said cavity toward and away from said upper opening, a crankshaft and a connecting rod secured to said piston and said crankshaft, the improvement comprising:

a triangular rotor having three surfaces each of a dimension sufficient to cover said opening means disposed over said block for housing said rotor;

second means for driving said rotor in an epitrochoidal path;

a fuel intake port;

a spent gas exhaust port;

third means for timing said rotor movement to sequentially communicate said intake port to said piston cavity, seal said cavity from said intake and exhaust ports and to communicate said cavity to said exhaust port while isolating the intake port therefrom.

7. The invention of claim 6 wherein said second means includes a rotor shaft end a member connecting said crankshaft to said rotor shaft.

8. The invention of claim 7 wherein said third means is an epitrochoidal drive mechanism.

9. A fuel-air compression device comprising:

an engine block having an upper surface and a cylindrical cavity formed in said block having an upper opening terminating in said upper surface;

a piston;

first shaft means to move said piston toward and away from said upper surface;

a triangular rotor disposed over said opening;

at least one planar surface on said rotor of a sufficient dimension to enclose said upper opening;

second shaft means to move said planar surface downwardly toward said upper opening as said piston is moving upwardly toward said upper surface;

third means to operatively connect said first and second shaft means;

a housing having an epitrochoidal chamber formed therein for receiving said triangular rotor and said chamber having;

a bottom opening disposed over said upper opening and having approximately the same dimension thereof; and, said second shaft means supports said rotor for rotative movement in said chamber.

10. The invention of claim 9 wherein a spark inducing means is mounted in said housing for inducing a spark in said chamber when said piston and said planar surface are in close proximity to one another.

11. A compression and sequencing system for use with a four stroke internal combustion engine of a type having a cylinder, a reciprocating piston in said cylinder defining a chamber of varying volume, a crankshaft and a connecting rod between said piston and said crankshaft, said system comprising:

a housing having an epitrochoidal shaped cavity and said housing having a bottom opening of substantially the same dimension as said cylinder and having an intake port and an exhaust port on either side of said bottom opening;

a triangular shaped rotor supported in said cavity for epitrochoidal movement and said rotor having three substantially planar sides defining chambers with said epitrochoidal cavity and each of said planar sides being sufficiently large to seal said bottom opening when adjacent thereto;

a rotor shaft carrying said rotor means to synchronize the movement between said crankshaft and said rotor shaft and to sequentially move one of said planar sides of said rotor to a sealing relationship across said bottom opening when said piston has reduced said varying volume to a minimum.

12. The invention of claim 11 wherein said means includes a belt connecting said rotor shaft and said crankshaft to move said rotor in an epitrochoidal path.

13. The invention of claim 12 wherein a spark inducing device is mounted in said housing and located in a manner to induce a spark in said chamber when of said planar sides is across said bottom opening.

* * * * *